US006089519A

United States Patent [19]

Laybourne

[11] Patent Number: 6,089,519

[45] Date of Patent: Jul. 18, 2000

[54] LIQUID CONTROL AND STORAGE SYSTEM

[76] Inventor: Sidney C. Laybourne, 507 Iowa Joe St., Suite B3, West Point, Iowa 52656

[21] Appl. No.: 09/082,912

[22] Filed: May 22, 1998

[51] Int. Cl.[7] ..... A47B 91/00; A47G 29/00; B65D 19/00

[52] U.S. Cl. ..... 248/346.11; 248/346.04; 220/212

[58] Field of Search ..... 248/346.11, 146, 248/311.2, 346.01, 346.04, 346.07; 220/212, 630, 737

[56] References Cited

U.S. PATENT DOCUMENTS

| | | | |
|---|---|---|---|
| 980,852 | 1/1911 | Van Court . | |
| 2,118,326 | 5/1938 | Richardson | 248/346.11 |
| 2,652,703 | 9/1953 | Keegan | 248/346.11 |
| 2,727,645 | 12/1955 | Dore | 248/246.11 |
| 2,963,256 | 12/1960 | Borah | 248/346.01 |
| 2,989,205 | 6/1961 | Yaws | 248/346.11 |
| 3,268,198 | 8/1966 | Swett | 248/346.11 |
| 3,606,074 | 9/1971 | Hayes | 220/42 |
| 3,633,863 | 1/1972 | Abbey . | |
| 3,809,353 | 5/1974 | Good et al. | 248/346.1 |
| 3,850,341 | 11/1974 | Bart . | |
| 3,929,312 | 12/1975 | Uke | 248/346.1 |
| 4,089,498 | 5/1978 | Woodruff . | |
| 4,733,790 | 3/1988 | Stein | 220/23.83 |
| 4,759,524 | 7/1988 | Anderson | 248/346.11 |
| 4,858,872 | 8/1989 | Witt . | |
| 5,123,558 | 6/1992 | Moloney | 220/212 |
| 5,273,182 | 12/1993 | Laybourne | 220/740 |
| 5,783,933 | 7/1998 | Persellin | 81/3.36 |
| 5,839,598 | 11/1998 | Mitchell | 220/231 |

FOREIGN PATENT DOCUMENTS

| | | | |
|---|---|---|---|
| 107203 | of 0000 | Germany | 248/346.11 |

*Primary Examiner*—Derek J Berger
*Assistant Examiner*—Michael Nornberg
*Attorney, Agent, or Firm*—Thomas E. Frantz

[57] ABSTRACT

A liquid control and storage system for use with different sizes of beverage containers, the system including an upwardly open generally cup shaped coaster which is automatically but releasably coupled to the lower portion of a container as it is inserted into the coaster and which provides for the receipt and storage of any condensate or other liquid draining from the sides and bottom of the container, with provision to prevent the back flow of stored liquid upon subsequent tilting of the container and coupled coaster. In a preferred embodiment, the storage facility consists of a cup like member which is carried by but detachable from the coaster and, after being emptied of any liquid therein, is attachable to the closure rim at the top end of the container to protect any contents therein from loss and contamination.

24 Claims, 6 Drawing Sheets

LIQUID CONTROL AND STORAGE SYSTEM

The present invention relates generally to coasters and closures for use with beverage containers and more particularly to a system for receiving and storing condensate and other liquid which may run or drip from the outside of a chilled beverage container and for closing the upper end of an opened container to store and protect beverage left in the container for later consumption or use. The system includes (1) a coaster adapted to releasably grip the lower portion of a beverage container and to remain with the container until it either is empty or set aside for later consumption of any remaining beverage, the coaster both collecting and safely storing condensate or other liquid draining from the sides of the container and (2) a closure member adapted to close and seal the upper end of a container after it has been opened, such closure protecting and storing any beverage left in the container for subsequent consumption or use. Advertising and promotional indicia may be provided on the coaster and/or on the closure member.

BACKGROUND OF THE INVENTION

A great majority of soft drinks, fruit juices, beer, wine coolers and other consumable beverages are sold in cans, bottles and other like containers which have been or are intended to be cooled either by refrigeration or immersion in ice cubes or ice water preparatory to being served. Containers chilled by immersion are, of course, "dripping" wet upon being removed from the cooler and opened. And even if a container is carefully dried, condensation will rapidly form on it if there is any significant temperature differential between the cooled container and the ambient air. Particularly if the surrounding air is hot and humid, such condensation will form rapidly and become heavy enough to run from the container onto the hands or clothing of the individual holding the container or onto a table or other piece of furniture on which the container may be placed. On fine furniture, of course, a moist or dripping container or can cause considerable damage through water stains, veneer separation, raised grain, and discoloration of table cloths, doilies, or other coverings.

Coasters, of course, have long been used to protect furniture against damage caused by moisture from cans and like containers. Should a container be carried from place to place, however, as is often done, it can be and often is difficult for the individual moving the container to remember either to carry a coaster along with the container or otherwise avoid placing the container on unprotected tables, desks and other articles of furniture.

The prior art does suggest coasters which are attachable to and movable with a beverage container. Such prior art devices fall far short of the features and advantages of the present invention, however, as they are limited to use with only one size of container. Accordingly, on occasions where a variety of different beverages might be served in different sizes of containers, the prior art devices would be useful only with some of the containers unless a different size of coaster should be purchased and made available for each different size of container. To provide a variety of different sizes of coasters, however, not only would involve extra expense but lead to such problems as not having enough coasters of one size and impatience in trying to find one that fits properly. Further, such prior art devices have not been part of a system capable of sealing and safely storing the contents of opened containers having closure rims of different sizes.

Unfortunately the above described problems have not been eliminated or materially alleviated by the use of mechanical refrigeration. A cold container or can, even if initially dry, will quickly collect condensation upon being exposed to warm moist air, as is commonplace throughout much of the year in many parts of the world.

Another problem with the usual beverage can or container is in providing for its re-closure should only a portion of its contents be consumed or used. In many cases, the original cover or cap is either not available or not suitable for re-use or, as with present day "pop-top" soft drink or beer cans, the closure is incapable of being re-sealed. Also, as a great percentage of today's consumers are highly conscious of health and safety matters, it is desirable to provide a practical and inexpensive way of protecting the "drinking" rim of a container against dirt and contamination after once being opened.

Further, as the several beverage industries are highly competitive and very dependent upon consumer recognition and selection at the point of purchase, there is a substantial demand both by producers and retailers in those industries for "eye-catching" yet inexpensive and appropriate advertising programs and products.

Over the years, various suggestions have been proposed for solving the problems and meeting the needs discussed hereabove. As far as is known, however, prior to the present invention, no one has been successful in designing, developing and producing a commercially viable dual purpose product which is inexpensive yet convenient and safe in use, and capable of solving and satisfying the aforesaid problems and needs.

SUMMARY OF THE INVENTION

The present invention provides a new and unique dual purpose product particularly adapted for use with beverage cans and containers in which soft drinks, beer, fruit juices and other like consumable beverages are chilled and served. This new product is not only uniquely suited to protect clothing and furniture against soiling and damage from the moisture and condensation usually present on containers of chilled beverages, but it also provides for the protection of the freshness and purity of the contents of such containers after they have been opened.

The invention includes an upwardly open generally cup shaped coaster which is sized to receive the lower portion of a can or other like container containing a chilled beverage. Within the coaster is structure for removably coupling the coaster to the container to ensure that the coaster will remain with the container until consciously removed by the user. Also included as part of the coaster is provision for rapidly and efficiently collecting and safely storing liquid which may form or otherwise be present on and drain from the sides of the container.

One important feature provided by of the present invention is that after being collected and stored by the coaster, liquid will not inadvertently backflow out of the coaster and onto the user or adjacent furniture when the container and coupled coaster are later tilted for drinking or pouring.

The liquid is held in a storage facility which provides storage either in a single space with capillary ingress and egress control or in a multiplicity of interconnected capillary size spaces. The storage facility preferably is formed of an olefin or other synthetic plastic which is inert to water, dish-washing detergents, and the various chemicals found in beer, wine, soft drinks, and similar consumable beverages. Should the storage facility be provided as a multiplicity of capillary sized spaces, a sintered particulate polyethylene or polypropylene material with an average mean pore size in a range of about 15–140 microns and a void volume in a range of about 30–60% has been found satisfactory for use in preparing an adsorbent storage facility. Any such material, of course, should be treated with an appropriate wetting agent to make it permanently hydrophilic and thus capable of rapidly absorbing and safely storing water and aqueous based compounds as might be present or formed as condensate on or run down the side of a container after a drink has been taken therefrom.

A coaster according to the present invention is readily adapted for use with all types of popular and widely used beverage containers. Probably the most popular and widely used container comprises an impact extruded aluminum can having a generally cylindrical body terminating at its lower end in an reduced foot portion and at its upper end in a reduced neck portion having an upwardly projecting annular rim or bead which is formed as the top of the container is closed and sealed.

Another popular and widely used container has a generally cylindrical body portion terminating at its lower end in a substantially flat bottom surface and at its upper end in a reduced neck and mouth. The usual glass beer or soft drink bottle typifies such a container.

Although the present invention is not limited to coasters or storage units of a circular shape, such a configuration usually will be found appropriate as most beverage cans or containers are generally cylindrical in shape and thus present circular upper and lower ends or surfaces. Accordingly, while the following description and appended drawings generally relate to circular structures, it is to be understood that in its broader aspects this invention clearly is applicable to coasters and storage units of rectangular and other shapes if intended for use with non-cylindrical containers.

Although a system based on the present invention may be configured for use with one specific size of container or one specific size of closure rim, an important feature of the invention is the provision of means for automatically coupling the coaster to the lower portion of a range of different sizes of containers and for sealing the open upper ends or closure rims of containers of a range of different sizes.

Another important feature of this invention is to provide a coaster defining an upwardly open receptacle, with means for automatically coupling the coaster to the container as its lower portion is inserted into the receptacle. Such coupling insures that condensate and other liquid which may be present on and drip or run from the sides of the container will at all times be received and safely stored by the coaster and held against any back flow no matter how badly the container may "sweat" or how often the coupled container and coaster may be moved from place to place or tilted as sips are taken from the container.

To provide this automatic coupling, the coaster preferably is molded of a semi-resilient form retaining plastic, such as one of the olefins, with a base section and a wall member integral with and projecting upwardly from the base section and defining an upwardly open receptacle. It will be understood, of course, that the size of the receptacle will be determined by the size or sizes of the containers intended to be used with the coaster. As pointed out above, on occasion there might be reason to limit the coaster to only one size of container as, for example, if it is intended to be used as a give-away with or to promote one specific brand of product. Particularly if the coaster is intended for general sale or use, however, the receptacle preferably should be sized to accept containers within a range covering at least the most popular sizes. For example, at the present time, a great preponderance of soft drinks, beers, and other beverages are packaged in containers which measure either about 2. 45" (6.223 cm) or about 2.65." (6.731 cm) in diameter larger and smaller ranges of containers are used in some instances to package certain specialized beverages, such as vegetable and fruit juices and the coaster could easily be adapted to satisfactorily accept and function with such other ranges. For purposes of the following discussion, however, reference will generally be made to the range indicated by the above specified diametrical figures.

In order to accomplish the automatic coupling feature provided by this invention, the interior periphery of the receptacle defined by the upwardly projecting wall member includes a plurality of integral shoulders which are directed inwardly toward the longitudinal axis of the coaster and which are concentric with and vertically spaced from one another and the base section of the coaster. The inner peripheries of the shoulders differ in diameter from one to another, and are arranged in somewhat of a stair-step fashion, with the smallest shoulder at the bottom and the largest at the top. For reasons which will be clear to those in the art, the inner periphery of each shoulder is slightly smaller in diameter than the outer diameter of the can or container which is intended to be engaged by that shoulder. Being molded of a semi-resilient material, however, the upwardly projecting wall member and integral shoulders are radially expandable when placed under outward tension. Thus, as the lower portion of a container is inserted into the receptacle, such insertion will cause the inner periphery of the applicable shoulder to expand around and frictionally grip such lower portion and thereby couple the coaster to the container.

In addition to the above described shoulders, the inner periphery of the wall member of the coaster includes a plurality of receptors for receiving liquid draining into the receptacle from the sides of a container coupled to the coaster. These receptors are arranged around the inner periphery of the wall member and provide for movement of liquid to the storage facility provided by the coaster. In one embodiment, the receptors are formed as vertically disposed slots or grooves formed in the inner periphery of the wall member. In another embodiment, the receptors comprise the innermost layer of capillary spaces of the inner periphery of the wall member.

Movement of liquid from the receptors into the storage facility is controlled by capillary action which also prevents the back-flow of liquid out of the storage facility as the container and coupled coaster are moved about and tilted, as in drinking or pouring beverage from the container.

The system provided by the present invention also includes provision for closing or sealing the open upper end of a container or can containing a quantity of beverage which is to be saved until a later time. Particularly if the retained beverage is carbonized or easily degraded upon extended exposure to the ambient air an airtight/watertight seal is required. At the same time, closure of the container will protect its contents and drinking rim against dirt and contamination. Such closure of a container is accomplished in a preferred embodiment of the invention by a unique cup shaped closure member which serves a dual function, first, the closure member serves as the storage facility for the coaster as described above and, secondly, it serves as a closure cap which is detachable from the coaster for use in closing and sealing an open container.

The cup shaped closure member includes a circular end wall and a generally cylindrical side wall integral with and projecting upwardly from the periphery of the end wall and terminating in an open upper end sized to receive the upper end of a container. It should be noted at this point that in describing and claiming the closure member in this application, it will be defined as though its end wall is positioned horizontally and its circular wall is extending upwardly as best seen in the lower section of FIG. 1 even though the closure member is inverted and the circular wall points downwardly when positioned over the upper end of a container for closure purposes.

Formed as part of the inner periphery of the side wall of the closure member is a series of annular recesses, each recess defining inwardly directed upper and lower annular lips. The recesses and annular lips are arranged in a stair-step fashion, with the smallest being at the bottom and the largest at the top of the side wall. As will be understood, the recesses and annular lips in the closure member are dimensioned to sealably receive and grip the top edge or closure rim or bead of the container with which it is intended to be used. For example, of the beverage containers now being used, a great majority consist of cans having closure rims measuring about 2.122" (5.389 cm), 2.225" (5.652 cm) or 2.340" (5.944 cm) in outside diameter and between 0.095" (0.241 cm) and 0.105" (0,267 cm) in height. Accordingly, by providing three appropriately sized recesses and associated annular lips in the side wall of the closure member, that one member will satisfactorily close and seal all known modern day beverage containers with closure rims coming within the above specified range.

During use of a preferred embodiment of the system with a chilled beverage can coupled to the coaster, the closure member is positioned below the coaster and arranged to receive and safely store liquid picked up by the receptors within the receptacle. Such liquid flows through the receptors to a basin-like area between the bottom of the container and the upper surface of the coaster base. From this basin, the fluid flows through a series of relatively small apertures, drains and capillary spaces into the closure member, now serving as a storage facility. As a result of certain features to be described in greater detail herebelow, fluid received in the storage facility is prevented from any back-flow out of that facility as the container and coupled coaster are moved about and tilted for sipping or pouring purposes.

As will be illustrated and described in more detail hereinafter, the storage facility may comprise an adsorbent sintered plastic porous member positioned within the receptacle of the coaster, or the coaster itself may be formed of an adsorbent sintered plastic porous material and thus comprise both the coaster and storage facility. In these latter two types of coasters, it is desirable to isolate the lower surface of the base section from a table or other article of furniture on which the coaster might be placed. This is particularly important in the case of the coaster formed entirely of sintered porous plastic material as moisture from the container could, if of any significant volume, permeate to the bottom surface of the base of the coaster and dampen and damage any underlying support such as a table or desk top. Such isolation may comprise a plurality of feet on the base of the coaster or it may include provision for removably holding a closure member as described generally above which has been adapted for removable attachment to the base.

Throughout the foregoing and following description, it will be understood that, as related to a container, the term "upper", "top" or "upwardly" has reference to that end of a can or container which normally is opened or uncapped to gain access to its contents, even should the container be oriented during use so that such end is no longer uppermost. The term "lower", "bottom" or "downwardly" has reference to the other end of the container the end which is not normally opened and on which the container usually is placed when put on a table, bench, counter or desk after its upper end has been opened. As related to the coaster, the term "upper", "top" or "upwardly" has reference to the position of the coaster when the lower surface of the base section is positioned horizontally, with the open end of the receptacle pointed up. The terms "inwardly" and "outwardly" have reference to a direction toward or away from the center point or transverse axis of the element referred to.

OBJECTS OF THE INVENTION

It is a principal object of this invention to provide an improved liquid control and storage system for use with beverage containers.

It is a further object of this invention to provide an improved coaster having a liquid storage facility adapted particularly for use with cans and other containers holding beverages normally served cold.

Another object of this invention is the provision of a liquid storage facility positioned to receive and safely store moisture and condensate from a cold beverage can or other container coupled to a coaster,.

A still further objective of this invention is to provide structure for automatically coupling a coaster to containers of a range of different sizes upon placement of a container on the coaster whereby the coaster is movable with the container.

Yet another abject of this invention is the provision of a system capable of serving both as a coaster to collect and safely store moisture from the bottom and sides of a can or container and as a closure for that container after it has been opened or uncapped.

A still further objective of this invention is the provision of an improved coaster which is simple, inexpensive and durable in construction yet highly efficient and convenient is use.

The above and other objects, features and advantages of the present invention will be apparent from the following description when read in association with the accompanying drawings.

DESCRIPTION OF THE PREFERRED EMBODIMENT

Figure 1:
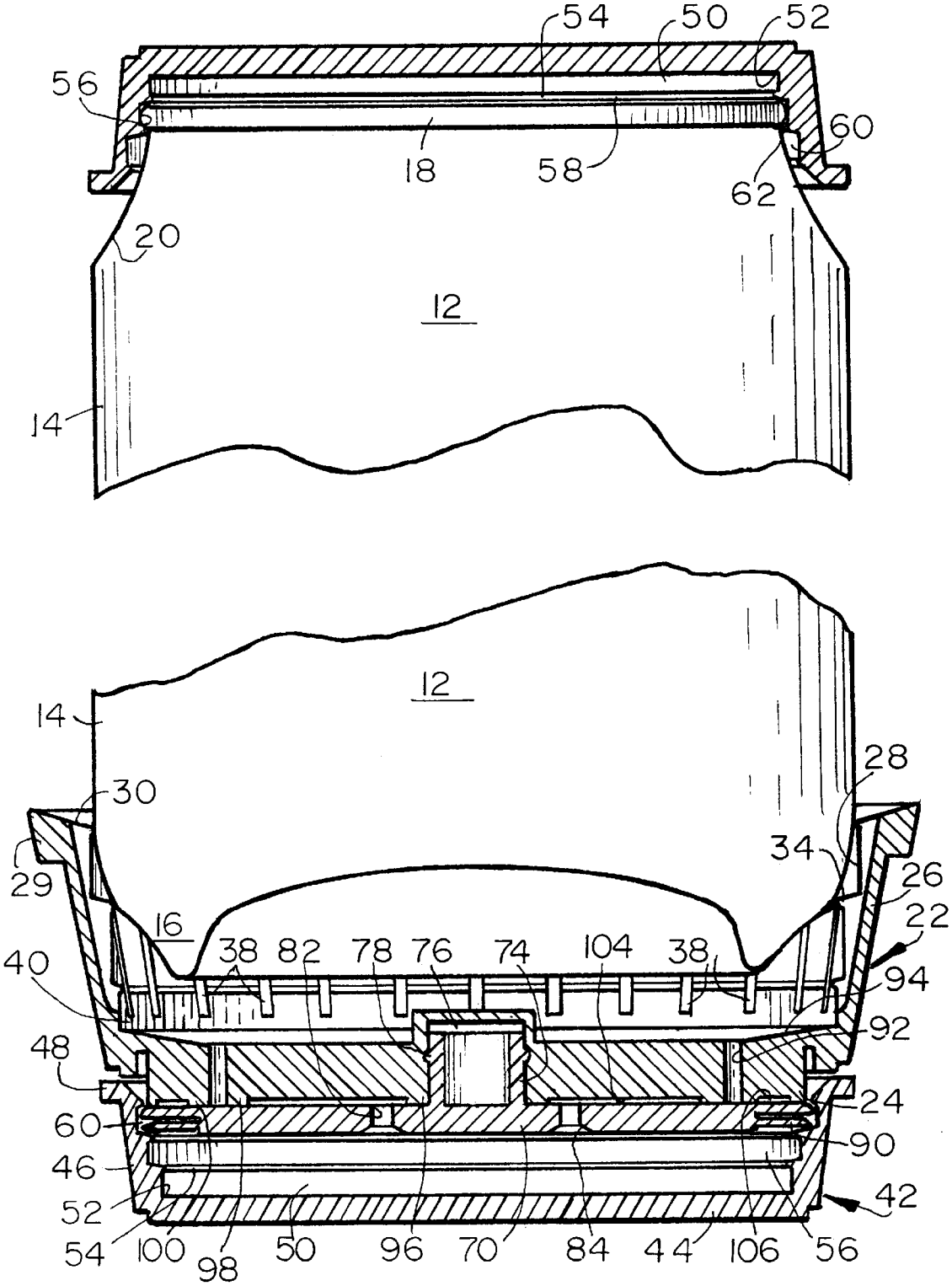
FIG. 1 is a cross sectional view of a system according to the present invention, the system including a coaster coupled to the lower end or foot of a metallic beverage container or can, with a removable closure member being shown both as a liquid storage facility for the coaster and as a closure cap for an open container.

Continuing now with a more detailed description of the preferred embodiment of the present invention, reference is first made to FIG. 1 of the drawings, showing a liquid control and storage system 10 adapted for use with beverage containers, such as the aluminum cans used very widely to package soft drinks, beer, juices and like beverages which normally are chilled before being served and consumed. As is well known in the art, a can 12 of this type has a generally cylindrical body section 14 terminating at its lower end in an inwardly tapered circular foot 16 and at its upper end in an upwardly projecting annular closure rim 18 formed around the reduced upper end 20 of can 12 at the time that the can top (not shown) is rolled or otherwise closed over the upper end 20.

The container 12 depicted in FIG. 1 is typical of a high percentage of all aluminum beverage cans currently in use. While minor tolerance differences will be found between cans used with the same beverage brands and between different beverage brands, the body section of practically all such cans has been found to fall into one of the two different diameters specified hereinabove. Larger and smaller ranges of containers may be used for specialized beverages, such as fruit juices, beer specials, and the like, but such containers represent a relatively small segment of the overall beverage business.

Also, as stated above, it has been discovered that in the two sizes of cans which fall within the above indicated range, the annular closure rims fall into a range of three sizes. The smallest measures about 2.122", the medium about 2.225" and the largest about 2.340". in height, these rims have been found to be quite uniform running between about 0.095" and 0.105".

As will be pointed out hereinafter in more detail, a fluid control and storage system according to the present invention will readily accommodate cans and containers with dimensional variations falling into ranges of the foregoing magnitude.

Figure 2:
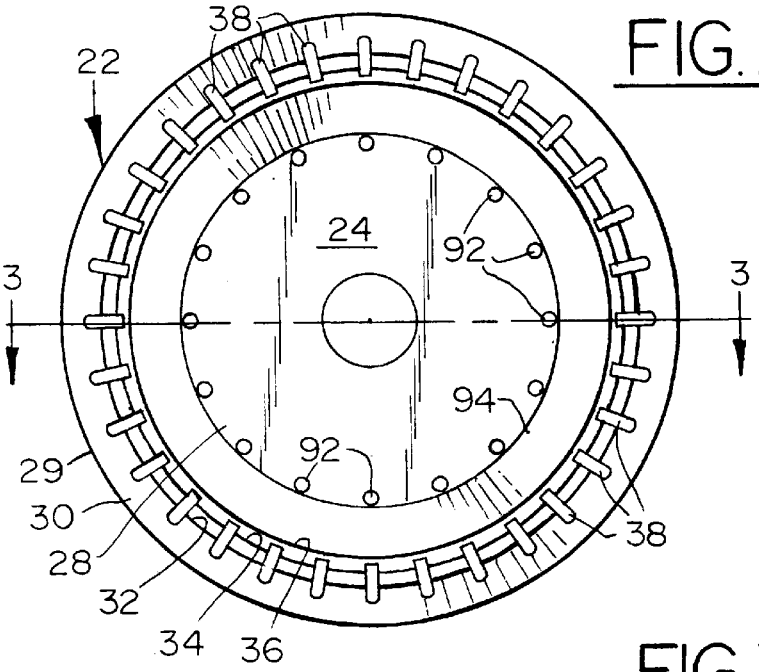
FIG. 2 is a top plan view of the coaster portion of the system of FIG. 1.
Figure 3:
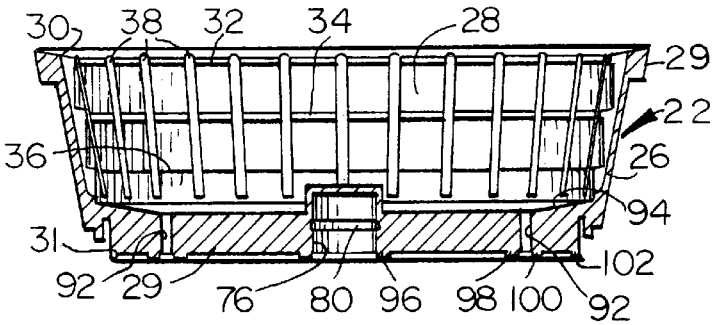
FIG. 3 is a cross sectional view of the coaster portion of FIG. 1, as taken on the line 3—3 of FIG. 2.
Figure 4:
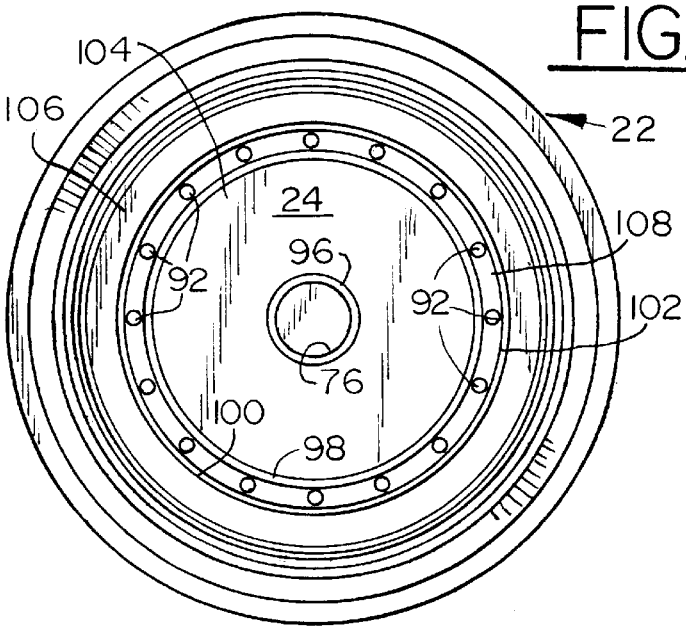
FIG. 4 is a bottom plan view of the coaster portion of the system of FIG. 1.
Figure 5:
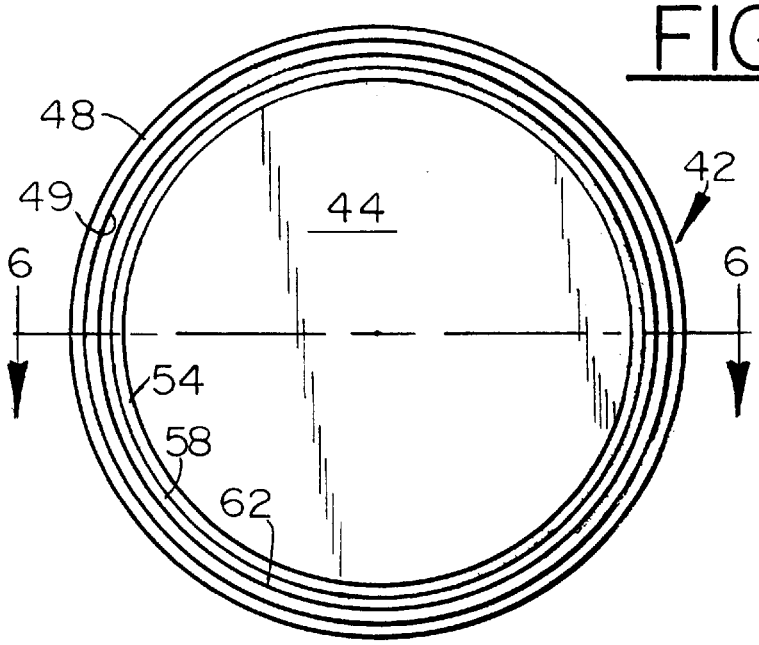
FIG. 5 is a top plan view of the closure member of the system of FIG. 1.

Referring now more particularly to FIGS. 2, 3 and 4, a preferred embodiment of the present invention includes a coaster 22, consisting of a generally circular base section 24, and a continuous wall member 26 integral with and projecting upwardly and sloping outwardly from the outer periphery of the base section 24. As will be noted particularly from FIG. 2, wall member 26 defines an upwardly open receptacle 28, and on its upper end terminates in an enlarged upper rim 29 having a relatively narrow circular surface 30 which slopes inwardly toward the receptacle 28. Integral with and depending from the lower surface of base section 24 is a relatively narrow circular extension, 31 the purpose of which will be described hereinafter.

As explained previously, an important feature of the present invention is the provision of a coaster which will automatically couple to the lower portion 16 of a container 12 upon its insertion into the receptacle 28. In the present embodiment, such automatic coupling is provided within receptacle 28 as part of its inner periphery by contact means comprising a pair of inwardly directed annular shoulders 32 and 34 which are concentric with and parallel to one another and the base section 24. These shoulders are spaced vertically from one another and are arranged in a stair-step fashion, with the smaller shoulder 34 at the bottom and the larger shoulder 32 at the top. Located below shoulder 34 is a third annular shoulder 36, the purpose of which will be described hereinafter.

It was explained earlier that a great majority of beverage containers consist of cans falling within a range of two diameters. It will be clear, therefore, that shoulder 34 should be sized to attach automatically to the smaller sized can and shoulder 34 should be sized for automatic attachment to the larger can. This automatic attachment feature is provided by sizing each shoulder approximately 0.010" (0.0254 cm) to 0.020 (0.0508 cm) smaller in inside diameter than the outside diameter of the can to be used with that shoulder. Thus, referring again to FIG. 1, as can 12 (larger size) is inserted into the receptacle 28, shoulder 32 and the adjacent portion of wall member 26 will expand radially to accept and frictionally grip the outer periphery of the lower portion of the body section 14. This grip is sufficient to keep the can 12 and coaster 22 coupled together as the can is lifted, moved about, and tilted. Upon insertion of a smaller sized can, shoulder 34 would then be forced to expand and grip the can to couple the coaster 22 to that can.

To provide for the radial expansion necessary to accept and grip a can as above described, coaster 22 preferably is molded from a form retaining yet semi-resilient synthetic plastic, such as polyethylene or one of the other low density olefins. Olefins are particularly suited for this application as they provide the degree of resiliency needed for the coaster while remaining inert to water, sugars, dish washing detergents, and the various chemicals found in soft drinks, beer, wine and other consumable beverages.

From FIG. 1 it will be seen that, while not acting to grip can 12, the smaller shoulder 34 does provide a stop or seat against which the inwardly tapered foot portion 16 will abut when the can 12 is fully seated, thus preventing any tilting or wobbling. Of the can 12 relative to the coaster 22. Likewise, the third and lowermost shoulder 36 in receptacle 28 will form a stop or seat for the lower foot portion of a smaller can upon its insertion into coupling engagement with shoulder 34.

As will be noted particularly from FIGS. 1 and 3, the exterior periphery of wall member 26 preferably slopes inwardly from the enlarged upper rim 30 to the base section 24 at an angle which will permit stacking of a quantity of coasters for packaging and display purposes by "nesting" the lower part of one coaster into the open upper receptacle of an underlying coaster.

Within receptacle 28 are a plurality of receptors 38 comprising a series of grooves or slots spaced around the inner periphery of wall member 26. As will be noted particularly from FIG. 3, the receptors are sloped at generally the same angle as the outer periphery of the wall member 26, and extend substantially the height of wall member 26 through shoulders 32, 34 and 36, thus, shoulders 32,34 and 36 are divided into a plurality of segments thereby eliminating any likelihood of an annular seal between any of the shoulders. And the outside periphery of any can inserted into receptacle 28. While the exact number of receptors 38 is not critical, 32 have been found desirable to assure for the immediate pick-up of any liquid initially on can 12 from immersion in ice or ice water and/or subsequently forming as condensate and running down the sides of the can. As will be readily understood, unless controlled, such liquid normally would run down and drip from the sides and bottom of the can onto the hands or cloths of the person holding the can or onto whatever table, counter, desk or other article of furniture on which the can might be placed.

Liquid and condensate draining from the sides of a can 12 will first be diverted inwardly toward the receptacle 28 by the sloping upper surface 31 of wall member 26. It will then be picked up by the receptors 38 and drain downwardly through such receptors, bypassing shoulders 32,34 and 36 and flow into a basin like area 40 formed between the bottom of can 12 and the upper surface of base section 24 of coaster 22. And while this basin area 40 is capable of safely retaining a certain amount of liquid, it may have a tendency to permit liquid to back-leak through receptors 38 if the basin 40 is substantially full and the can 12 and attached coaster 22 are tilted as in drinking or pouring from the can 12.

To increase the liquid storage capacity of coaster 22, storage means are provided, such means comprising in this embodiment a generally cup shaped member 42 which serves two different functions in the system. In one position, it serves as a liquid storage facility for coaster 22. In a second position, it serves as a closure member for sealing the open upper end of a can containing a quantity of beverage which is to be saved until a later time.

Figure 6:
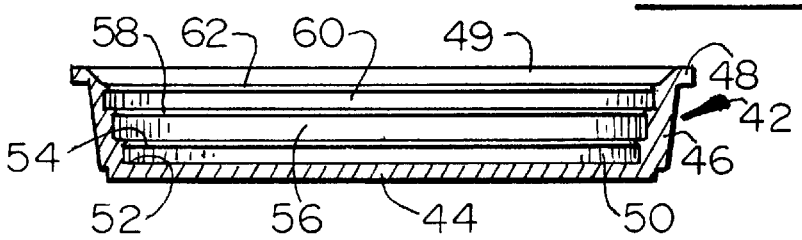
FIG. 6 is a cross sectional view of the closure member of the system of FIG. 1, as taken on the line 6—6 of FIG. 5.
Figure 7:
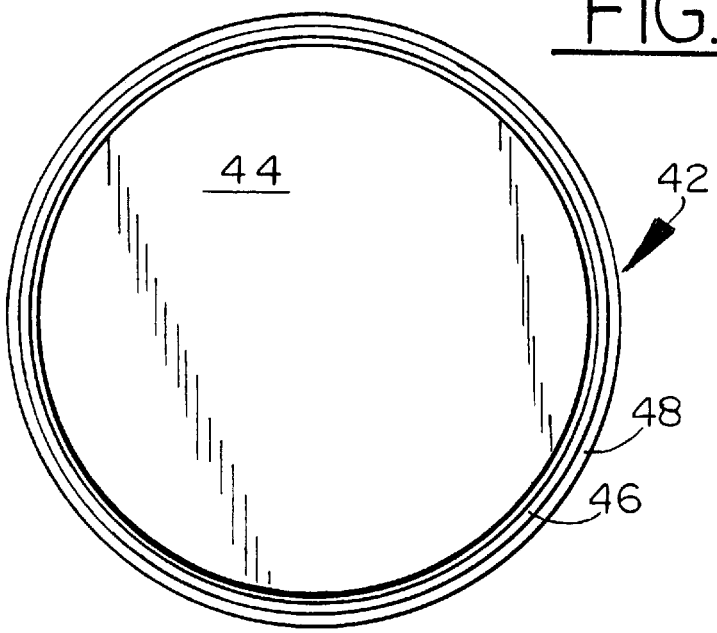
FIG. 7 is a bottom plan view of the closure member of the system of FIG. 1.

The cup shaped member 42, hereinafter generally called a closure member, is shown in FIG. 1 in position to serve as the storage facility for the coaster 22. The closure member 42 preferably is molded of the same semi-resilient form retaining olefin material as the coaster 22, and comprises a generally circular end wall 44 and a generally cylindrical side wall 46 integral with and extending upwardly from the outer periphery of end wall 44. As indicated best in FIG. 6, the side wall 46 slopes outwardly and terminates in an enlarged rim 48 surrounding open upper end 49, which open end is sized to receive the narrow annular extension 31 of base section 24 as well as the largest annular closure rim 18 in the range of cans intended to be used with the system. When in position as the storage facility, the closure member 42 is releasably held directly under the base section 24 of coaster 22, with its open upper end 49 positioned around and in close proximity to the circular extension 31. It will be noted from FIG. 1 that the enlarged rim 48 extends radially outwardly beyond the exterior periphery of wall member 26 at its lower edge. This enlarged rim not only provides a conveniently accessible gripping flange for use during assembly and removal of the closure member 42 from coaster 22, but also serves to intercept and divert into the closure member for storage therein any liquid which might occur on and drain down the outer surface of wall member 26.

Formed in the inner periphery of side wall 46 are three annular recesses, each of which defines inwardly directed upper and lower annular lips. The recesses and annular lips are arranged in a stair-step fashion, with the smallest recess 50 and adjacent lips 52 and 54 being at the bottom, medium recess 56 and adjacent lips 54 and 58 being centrally disposed, and the largest recess 60 and adjacent lips 58 and 62 being proximate the top of side wall 46. For simplicity and space saving purposes, it will be noted that lip 54 serves as both the upper lip for recess 50 and the lower lip for recess 56, and that lip 58 serves as both the lower lip for recess 60 and the upper lip for recess 56.

Figure 8:
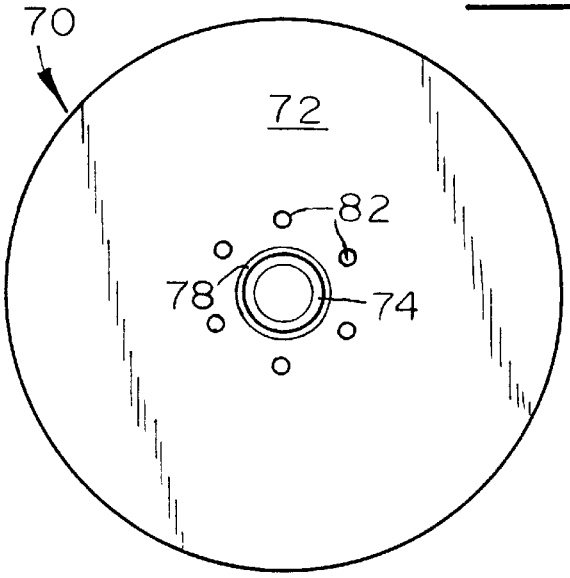
FIG. 8 is a top plan view of the flow control member of the system of FIG. 1.
Figure 9:
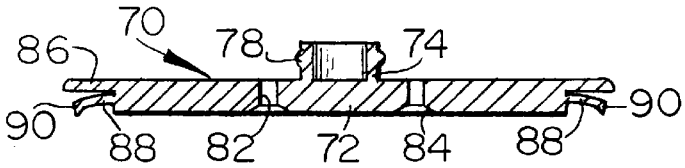
FIG. 9 is a cross sectional view of the flow control member of the system of FIG. 1, as taken on the line 9—9 of FIG. 10.
Figure 10:
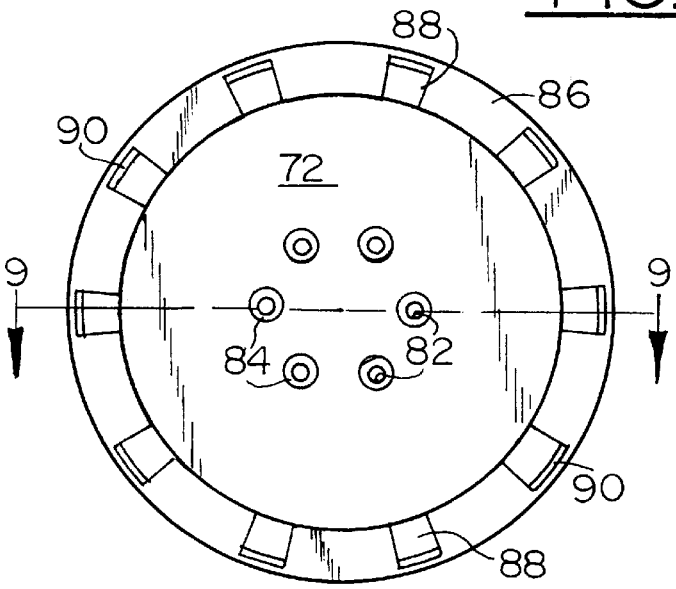
FIG. 10 is a bottom plan view of the flow control member of the system of FIG. 1.

Flow control means, operatively disposed between the base section 24 and the closure member 42, provides for the movement of liquid between the basin 40 of coaster 22 and the interior of closure member 42 when serving as a storage facility. Such means comprises a generally circular control disc 70 preferably molded from the same semi-resilient form retaining plastic material as the coaster 22 and closure member 42. As best shown in FIGS. 8, 9 and 10, the control disc 70 comprises a flat central portion 72 having an integral centrally disposed hollow cylindrical hub 74 extending upwardly therefrom into removable engagement with bore 76 formed centrally through the bottom surface of the base section 24 of coaster 22. While hub 74 may be threaded or otherwise releasably secured in bore 76, in the illustrated embodiment the hub 74 is provided with a circular bead 78 which snaps into a complimentary circular indent 80 in bore 76 as the control disc 70 is pressed into contact with the bottom surface of base section 24.

Control disc includes a plurality of relatively small ports 82 arranged in a circular pattern around hub 74. Ports of a diameter of about 0.045" to 0.065" (0.114 cm to 0.165 cm) have proven to function satisfactorily, with the lower end thereof being beveled as at 84 for a purpose to be explained hereinafter. In addition, at the periphery of the central portion 72 of control disc 70, there is provided a relatively thin outwardly projecting flange 86 (best seen in FIG. 9) terminating in a rounded upper edge 87 sized to snap past upper lip 62 and into recess 60 of closure member 42. Also extending outwardly from the periphery of the central portion 72 are a plurality of resilient fingers 88, having distal ends 90 which taper downwardly and terminate on a circle also sized to snap past upper lip 62 and into recess 60. In entering into recess 60, the distal ends 90 abut upper flange 58 and because of their resiliency bias the control disc 70 upwardly to a position wherein the rounded edge 87 normally is in contact with and closes the opening defined by upper lip 62. Such closure, of course, will substantially seal the interior of the closure member from the atmosphere except through ports 82. It will be understood, however, that upon the application of pressure or weight to the control disc, the resiliency of fingers 88 will permit downward movement of the control disc 70 and flange 86 to space the rounded edge 87 from upper lip 62 and thus open the interior of closure member to the atmosphere.

Referring now to FIGS. 3 and 4, it will be noted that base section 24 includes a plurality of relatively small drain apertures 92 arranged in a circular pattern at the inner edge of a sloped collar 94 which extends inwardly from the bottom of wall member 26 internally of the receptacle 28. It will also be noted that the lower surface of base section 24 is provided with several concentric spacer rings, including a central ring 96 around bore 76, intermediate inner and outer rings 98 and 100 on opposite sides of drain apertures 92, and edge ring 102 around the outer periphery of the bottom surface of base section 24. The circular recesses between these rings are relatively shallow and form capillary spaces when the control disc 70 and base section 24 are assembled as illustrated in FIG. 1. For example, in depth, circular space 104 preferably runs between 0.025" and 0.035" (0.064 cm and 0.089 cm), space 106 between 0.005" and 0.010" (0.013 cm and 0.025 cm), and the recess 108 into which drain apertures 92 open, between about 0.010" and 0.015" (0.0254 cm and 0.038 cm). Such spacing, of course, is readily maintained by the rings as just described.

Upon assembly of the coaster 22, control disc 70 and closure member as a storage facility in the manner above described, it will be noted that in the absence of pressure or weight on the coaster 22 and hence on the control disc 70 , the interior of the closure member 42 will be substantially isolated from the atmosphere except through a channel consisting of ports 82, capillary space 104, drain apertures 92 and receptacle 28 of coaster 22. Upon the application of weight or pressure to the coaster 22 and control disc 70, however, as in inserting a full beverage can into the coaster, the weight of the can will cause the coaster and control disc to move downwardly relative to the closure member and hence open the interior of the closure member to the atmosphere. The purpose and effect of this closing and opening of the liquid storage facility will be explained in more detail hereinafter.

As pointed out previously, the annular closure rims 18 of a majority of beverage cans now in use measure about 2.122", 2.225" or 2.340" in outside diameter, and between 0.095" and 0.105" in height. Thus, to assure the creation of a liquid/air tight seal with any of these closure rims 18 when the closure member 42 is used to seal an open partially filled container, it is desirable to size the inside diameter of each recess in the closure member about 0.010" smaller than the outer diameter of the annular closure rim 18 intended to be sealed in that recess. Further the annular lip preceding each recess should be about 0.020" (0.0508 cm) in width and project inwardly beyond the recess by about 0.010" (0.0254 cm). These dimensions have been found adequate to permit application of the closure member 42 to the closure rim 18 of can 12 without undue manual pressure while still providing a fit which is tight enough to the prevent the inadvertent "pop-off" of the closure member 42 should the can be partially filled with a carbonated beverage and inadvertently dropped or shaken.

From the preceding description, it is believed that the function of the coaster 22, control disc 70, and closure member 42 will be clear. After a beverage container 12 has been removed from a cooler containing ice or ice water or from a mechanical refrigerator and opened, its lower portion 16 should be inserted into the receptacle 28 of coaster 22 and pushed downwardly therein until firmly seated. Should one of the larger cans have been selected, the outer periphery of its lower portion will press into and cause the larger or upper shoulder 32 to expand and releasably grip the can, with the foot of the can seating on the lower or smaller shoulder 34. Or if one of the smaller cans should have been selected, its lower portion will be releasably griped by shoulder 34, and seated against shoulder 36. Because of the semi-resilient form retaining nature of the material used in molding coaster 22, the shoulders 32 and 34 will press against the larger and smaller cans, respectively, with sufficient force to couple the coaster and can so that the coaster and can are movable as a unit until being manually separated.

Upon assembly of a chilled can of beverage with the coaster 22, any moisture or liquid initially present on or later forming as condensate on the exterior of the can will drain down the sides of the can and, assisted by inwardly sloped surface 30, will run into the receptacle 28, where it will be picked up by receptors 38 and channeled to the bottom of the wall member 26 into basin 40. Thereafter, the liquid will drain down the sloped collar 94 into and through drain apertures 92 in base section 24 and then into the circular space or recess 108 formed by concentric intermediate rings 98 and 100. From that recess 108, the liquid will seep between the lower surface of ring 98 and the juxtaposed upper surface of the control disc 70 into circular space or recess 104 and finally through ports 82 of control disc 70 into closure member 42 acting as the reservoir facility. The bevel 84 at the lower end of ports 82 has been found to assist in moving liquid through the ports as the flaring effect of the bevel tends to spread and thus weaken the meniscus which would otherwise tend to form at and impede liquid flow out of the sharp edge of a small round aperture. It should also be mentioned that of the liquid initially entering space 108 from drain apertures 92, a small percentage will seep between the lower surface of ring 100 and the juxtaposed upper surface of the control disc 70 and into circular space or recess 106. However, as this recess is narrower and thus higher in capillarity than recess 104 and has no natural outlet, no "leakage" has been found between edge ring 104 and the juxtaposed surface of the control disc 70.

It will be understood that as liquid enters the closure member 42 from the basin 40 of coaster 22, air must be permitted to vent to the atmosphere. When the coaster 22 with attached closure member 42 is resting on a counter, desk, or the like, the weight of the can will cause compression of fingers 88 of disc 70 and movement of coaster 22 and control disc 70 downwardly relative to shoulder 62 of the closure member 42, thereby moving the rounded edge 87 of flange 86 away from shoulder 62. Accordingly, as liquid enters the storage facility provided by the closure member, air will vent to the atmosphere through the space between shoulder 62 and edge 87 of the flange 86. Thus, so long as the can with coaster attached is rested periodically on a table or counter, liquid will be permitted to flow into the storage facility from the basin 40 and air simultaneously vented from the storage facility to the atmosphere.

Upon picking up a can with coaster attached, the weight will be removed from the coaster 22 and control disc 70, thereby permitting fingers 88 to move the flange 86 into engagement with shoulder 62 to close the storage facility against further venting. Accordingly, air no longer has direct ingress into the storage facility. Such lack of venting plus the capillary strength of the several small spaces and openings through which liquid must traverse to enter the storage facility are effective to prevent any back-flow of liquid from the storage facility as the can with coaster attached is moved about and tilted for drinking and/or pouring purposes. The little liquid that might be in the basin 40 or still in the receptors 38 at any given time is not problematic as the receptors, the interior of the receptacle 28 and the areas of contact between the segments of the shoulders 32–36 and can periphery in the aggregate provide a multiplicity of small corners and tight spaces which collectively are more than adequate to retain any liquid not transferred to the storage facility.

It should be mentioned at this point that because of the capacity of the closure member 42 when used as the storage facility for coaster 22, the coaster is capable of safely accepting and storing the liquid and condensate generated by several cans of chilled beverage before it may need to be emptied. Thus, one normally does not need to be concerned about emptying the closure cap during a social or business event even though several chilled drinks may be consumed.

Should a portion of the contents of can 12 be left for later consumption or use, such contents can be kept fresh and protected against contamination by removing the closure member 42 from the control disc 70, emptying any liquid which may be present therein, and inverting the closure member and snapping it over the closure rim 18 of can 12. As pointed out previously, the two most popular sizes of cans include three different diameters of closure rims, all of which are accommodated readily for closure purposes by the closure member 42 of the present invention.

The upper portion of FIG. 1 depicts the closure member 42 as being mounted on the inwardly tapered upper end 20 of can 12, with the closure rim 18 of can 12 being disposed in recess 56 and between lips 54 and 58. In the particular range of sizes discussed previously, this recess is intended for use with a container having a closure rim 18 of about 2.225" in diameter. Thus, the inside diameter of recess 56 should run about 2.215" in diameter to assure a liquid/air tight seal around the rim 18. Further, the lips 54 and 58 preferably are about 0.015" to 0.020" thick on their inner periphery to assure sufficient rigidity to prevent any "pop-off" of a closure member should a can containing carbonated liquid be dropped or shaken. In addition, in diameter, the inner periphery of lip 58 preferably is about 0.010" smaller in diameter than recess 56 to further assure against any such inadvertent loss of the closure member. It will be understood, of course, that the dimensions of the other recesses 50 and 60 and lips 54 and 62 are to be determined in a like manner, depending on the size and nature of the closure rims or edges to be sealed.

DESCRIPTION OF OTHER EMBODIMENTS

Figure 11:
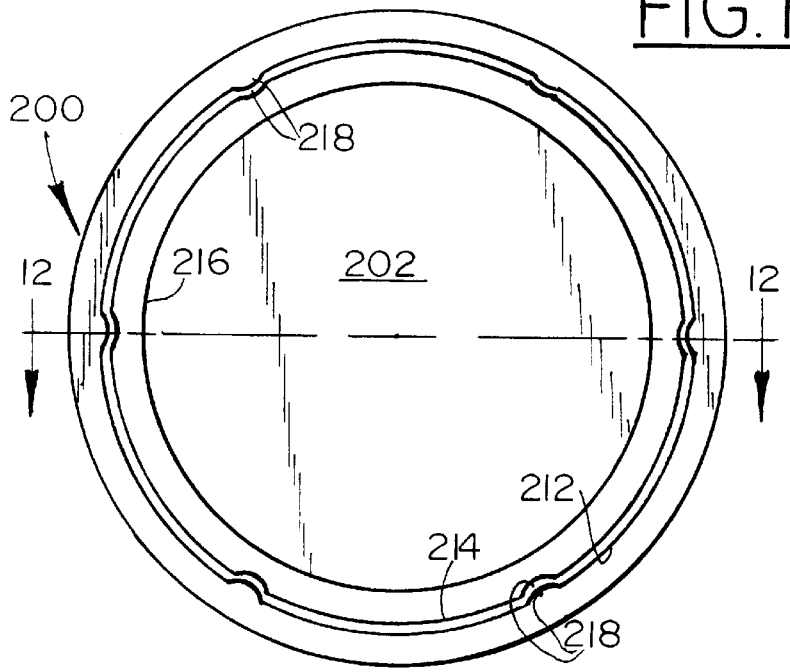
FIG. 11 is a top plan view of another embodiment of this invention, wherein the coaster is comprised of sintered porous plastic material.
Figure 12:
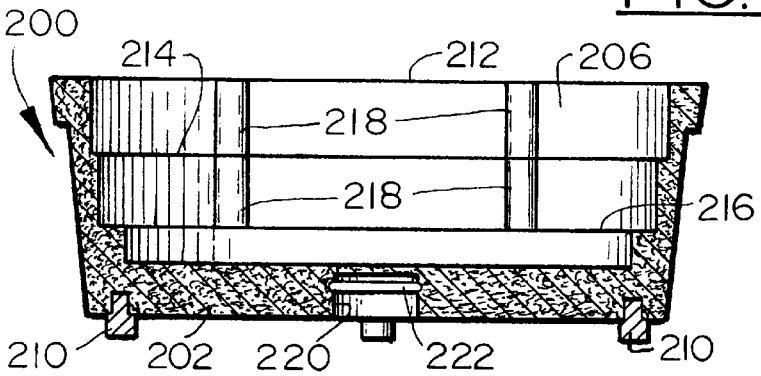
FIG. 12 is a cross sectional view of the coaster of FIG. 11, the coaster being shown without a closure member or attached container for simplicity purposes.

Referring now to FIGS. 11 and 12, there is shown a generally cylindrical coaster 200 which is attachable to a range of beverage cans or other containers and in which the liquid storage facility for the coaster is an integral part of and not removable from the coaster. The coaster of this embodiment consists of a generally circular base section 202, and a continuous wall member 204 integral with and extending upwardly and sloping outwardly from the outer periphery of the base section 202. As with the embodiment of FIGS. 1–10, the wall member 204 defines an upwardly open receptacle 206 and on its upper end terminates in an enlarged upper rim 208. Depending from and evenly spaced around the periphery of the base section are a plurality of feet 210 formed of a non-porous plastic or other suitable material.

Coaster 200 will automatically couple to the lower portion of either size of beverage can 12 as discussed above with reference to the earlier embodiment, upon its insertion into the receptacle 206. This feature is provided within receptacle 206 as part of its inner periphery by contact means comprising a pair of inwardly directed annular shoulders 212 and 214 which are concentric with and parallel to one another and the base section 202. These shoulders are spaced vertically from one another and are arranged in a stair-step fashion, with the smaller shoulder 214 at the bottom and the larger shoulder 212 at the top. Located below shoulder 214 is a smaller third annular shoulder 216.

For the reasons explained earlier, shoulder 214 should be sized to attach automatically to the smaller sized can and shoulder 212 should be sized for automatic attachment to the larger can. This automatic attachment feature is provided by sizing each shoulder a few thousandths of an inch smaller in inside diameter than the outside diameter of the can to be used with that shoulder. Or should a continuous shoulder be found to create excessive resistance to the insertion and removal of cans from either or both shoulders, such resistance may be reduced by enlarging the shoulders slightly while adding a series of inwardly projecting splines around the interior periphery of the wall member immediately below the shoulders.

The coaster 200 is molded or otherwise formed of a porous material produced by a sintering process from a particulate plastic material such as polyethylene or polypropylene which is capable of providing a strong yet semi-flexure material. Preferably, the material of the coaster will provide a multiplicity of randomly disposed interconnected capillary spaces, with a mean micron pore size ranging between about 15–140 microns, and a void volume in the range of 30–60 percent. Olefins of the above mentioned type normally are not hydrophilic and thus need to be treated to make them permanently wettable by water and other aqueous liquids. Such treatments are well known in the art and thus do not require their recitation herein.

Referring again to FIGS. 11 and 12, as a larger size beverage can is inserted into the receptacle 206, shoulder 212 or the splines 218 provided on shoulder 212 will expand radially to accept and frictionally grip the outer periphery of the lower portion of the can. This grip is sufficient to maintain the can and coaster 200 coupled together as the can is lifted, moved about, and tilted. Upon insertion of a smaller sized can, shoulder 214 or the splines 218 provided for shoulder 214 will expand radially to accept and grip the can to couple the coaster 200 to that can. As mentioned above, the expansion of shoulders 212 and 214 is permitted by virtue of the nature of the olefin used to produce the coaster. Olefins are particularly suited for this type of application as they provide the degree of resiliency needed for the coaster while remaining inert to water, sugars, dish washing detergents, and the various chemicals found in soft drinks, beer, wine and other consumable beverages.

In a porous coaster of the type under discussion, the pores immediately in contact with the can will serve as the receptors for liquid from the sides and bottom of the can. Liquid received by these receptors will be transferred to the pores located elsewhere in the coaster and such remote pores will then serve as the storage facility for the coaster 200.

As the pores on the exterior of the base section 202 will become damp as moisture is received by the receptors, it is necessary to insure that the bottom of the base section 202 does not come into contact with the top of a desk, counter, table or other item of furniture on which the coaster may be placed. Normally coaster 200 will cary a closure member of the type illustrated in FIG. 13. To provide the necessary isolation. However, as the pores of the coaster could still be moist after removal of a partially filled can from the coaster and use of the closure member for sealing the open upper end of that can, feet 210 are provided in order to insure the necessary isolation.

Figure 13:
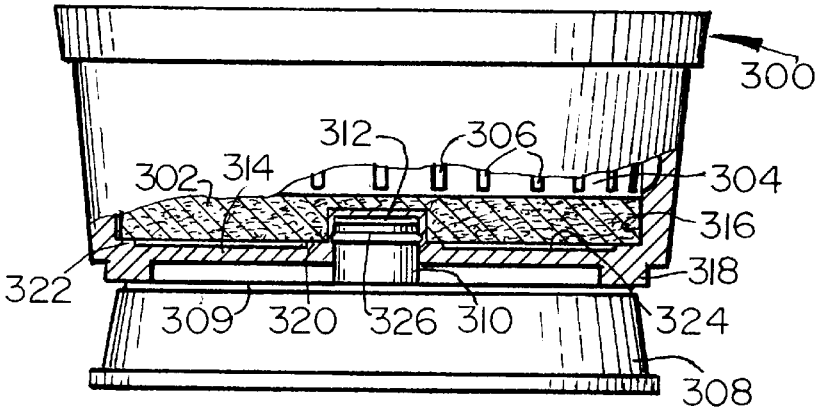
FIG. 13 is a side view, partially in cross section, showing another embodiment of the invention, the coaster portion being similar to that of the embodiment of FIG. 1 except the storage facility and closure member are separate elements, with the storage facility being positioned within the receptacle and the closure member being removably attached directly to the base section of the coaster.

As will be noted, base section 202 of the coaster 200 includes a centrally disposed bore 220 which opens through the bottom of the base section 202 for releasable reception of an upwardly extending hub of a closure member such as the one illustrated in FIG. 13. Disposed within the bore 220 is a circular indent 222 which is intended to provide a "snap" connection between the bore 220 and the hub of the cover member.

Turning now to the embodiment of FIG. 13, the coaster 300 shown therein is substantially the same in structure and function as the coaster 22 of the embodiment of FIG. 1 except that the FIG. 13 coaster (1) utilizes as its storage facility a porous plastic insert 302 located within the receptacle 304 at the lower end of the receptors 306 rather than an externally located closure member, and (2) carries a closure member 308 which is supported directly on the coaster 300 rather than by a separate member, such as disc 70, disposed between the coaster 300 and closure member 308.

The porous plastic insert 302 comprises a generally circular disc preferably formed of a sintered particulate plastic material which has a multiplicity of randomly disposed intercommunicating capillary spaces and which is inert to but made permanently wettable to assure rapid adsorption of water and various aqueous compositions normally present in soft drinks, beers, fruit juices and other beverages. As in the coaster described above with reference to FIGS. 11 and 12, the particulate material used in preparing the disc 302 preferably consists of an olefin, with the finished sintered material having a mean micron pore size ranging between about 15 and 140 microns and a void volume of 30 to 60 percent. In outside diameter, the disc 302 preferably is slightly larger than and thus is frictionally though releasably held in the circular space 316 at the lower end of the receptors 306. As will be understood by those in the art, other holding arraignments may be utilized, such as a series of splines between the disc and the surrounding wall, so long as disc 302 is held in but conveniently removable from the coaster for washing and cleaning purposes. Also, as will be noted, the circular disc 302 is spaced a short distance above the upper surface of the base section 314 by a pair of relatively narrow spaced concentric rings 320 and 322 to provide a circular air space 324 between and insulate the base section 314 from the disc 302. Such spacing will substantially reduce any tendency for the base section to become cool enough to "sweat" from chilled water held in disc 302.

As will be noted from FIG. 13, the outer periphery of the base section 314 of coaster 300 is provided with a series of downwardly depending feet 318 which, in the absence of the closure member 308, will support coaster 300 and an attached can on a table, counter, desk or other relatively level surface. Depending upon the heat transfer rate of the material of the base section 314 and the remote possibility of space 324 filling with chilled water after saturation of disc 302, there is a possibility of the generation of condensation on the lower surface of base section 312 of the coaster 300. Thus, it is desirable to provide feet 318 or some other means for spacing the base section 312 from any desk, table or other surface on which the coaster (less the closure member 308) with attached container may be placed. the closure member 308 preferably is kept with the coaster 300 to assure its availability whenever the user may wish to seal a can with contents which are to be kept for later consumption or use. In the present embodiment, this feature is provided by centrally disposed hub 310 which, as mentioned above, extends from the end wall 309 of closure member 308 into bore 312, which bore opens through the bottom surface of base section 314. For a purpose to be described herebelow with reference to FIG. 14, the hub preferably is hollow and removably held in bore 312 by an interengaging circular bead and groove arrangement 326. In terms of its structure, function and use in sealing the open upper end of partially filled cans or containers of the types discussed heretofore, closure member 308 is substantially the same as the closure member forming a part of the system of the embodiment of FIG. 1. Accordingly, a repetition of that earlier discussion is not believed to be necessary at this point.

Figure 14:
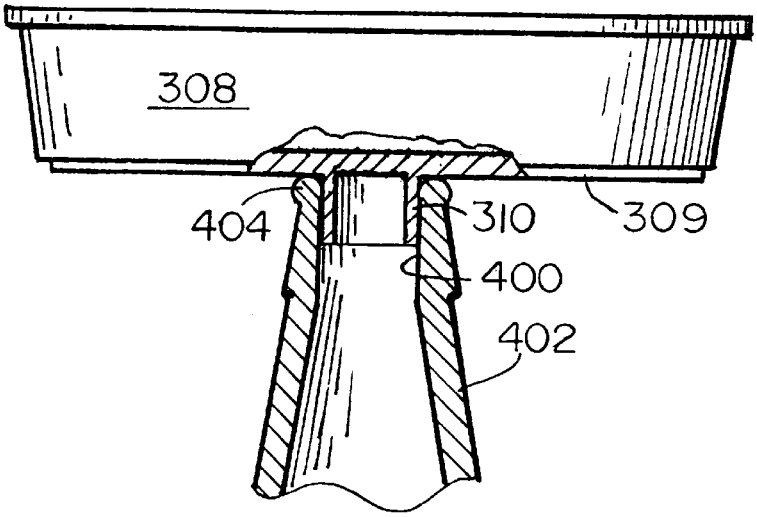
FIG. 14 is a fragmentary side plan view, partially in cross section, showing the closure member of the embodiment of FIG. 13 as used to sealably close the upper end of a beverage bottle.

Referring now to FIG. 14, there is shown an additional use of the closure member 308 as illustrated and described in connection with the embodiment of FIG. 13. In this additional use, the closure member 308 is simply inverted and the hub 310 pressed into the mouth 400 of an open beverage bottle 402. In this connection, it has been found that both the interior and exterior dimensions of the mouth area of most beverage bottles are relatively consistent, and in most cases any deviation in such dimensions can be readily accommodated by the hollow nature of the hub 310 combined with the semi-resilient nature of the olefin material from which it is molded.

In the present embodiment, the hub 310 of the closure member 308 is sized to sealably and tightly fit within the mouth 400 of the bottle 402. It will be understood, however, that the hub 310 could be sized to sealably fit over the exterior of the mouth 400 of bottle 402, to take advantage of the undercut 404 present on all such bottles for initial capping purposes. Or if believed necessary provide optimum resistance to inadvertent "blow-off" of the closure member 308 as a result of pressure within the bottle 402, the hub 310 could include two concentric walls spaced to tightly receive the bottle mouth 400 therebetween. Also, should the presence of the complete closure member 308 not be desired in closing the open end of a bottle 402, the hub 310 portion could be made to separate from the closure member itself.

Figure 15:
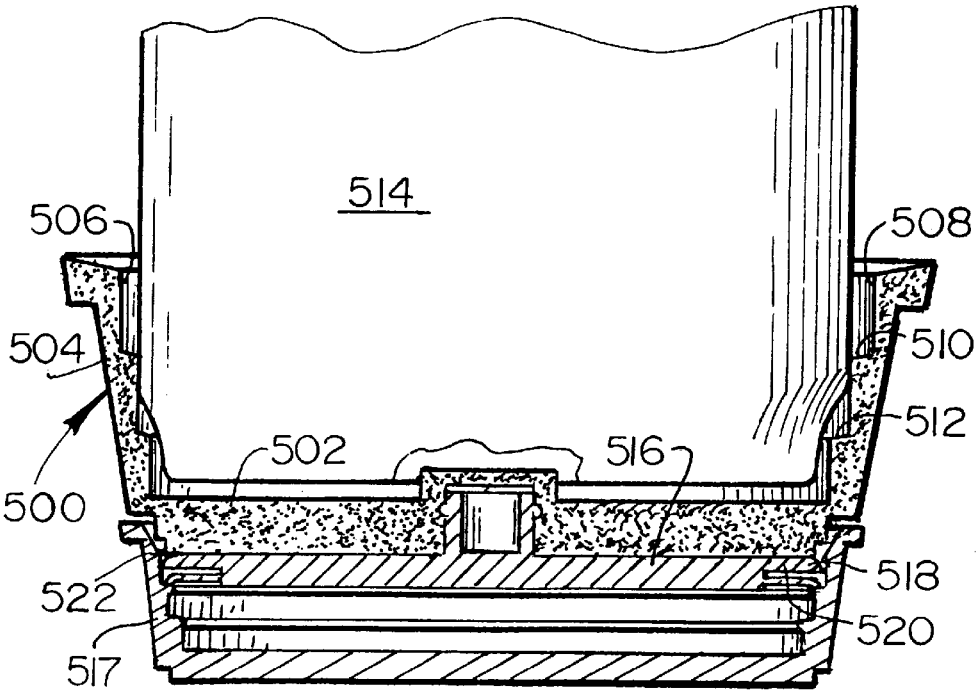
FIG. 15 is a cross sectional view of another embodiment of a system according to the present invention, the system including a coaster coupled to the lower portion of a beverage container or bottle, with a removable closure member attached to and serving as the storage facility of the coaster.

The embodiment of FIG. 15 basically represents a combination of the porous coaster 200 of FIG. 12, less feet 210, and the closure member 42 and control disc 70 of the embodiment of FIG. 1. Thus while it is not believed necessary to describe in detail the structure, function and use of the system of this FIG. 15 embodiment, the following is to be noted.

As with the coaster of FIG. 12, the coaster 500 of the present embodiment comprises a circular base section 502 and an upwardly projecting wall member 504 defining internally thereof a receptacle 506 provided with a series of spaced shoulders 508, 510, and 512. The lower portion of a beverage can or container 514 is shown as being positioned in receptacle 506 in removable engagement with middle shoulder 510. As will be understood from the earlier description, any liquid running down the sides of can 514 into receptacle 506 will first be adsorbed by the capillary pores in contact with the can 514, which pores then act as receptors to transfer liquid to other interconnected pores throughout the coaster. As the pores become filled, liquid will migrate downwardly under the force of gravity to the upper surface of control disc 516. It will be noted that in this embodiment, ports (such as ports 82 in the embodiment of FIG. 1) have not been found necessary as liquid reaching disc 516 will move outwardly toward its outer periphery and then drain into closure member 517 through space resulting from the weight of beverage can 514, between the rounded upper edge 518 of flange 520 of disc 516 and upper lip 522 of closure member 517. Simultaneously, air will be vented from the control member 517 through such space, into the atmosphere. In this connection, one of the primary advantages of this FIG. 15 embodiment is that it provides two storage facilities: first in the pores of the coaster 500 and secondly in the closure member 517. Also, as will be obvious to those skilled in the art, attachment of the closure member 517 to control disc 516 and attachment of control disc 516 to the base section 502 of the coaster 500 are substantially the same as the attachment of corresponding parts in the FIG. 1 embodiment.

Obviously, many modifications, variations and substitutions of materials and dimensions will be possible in light of the teachings of this specification. Also, it will be understood that systems constructed according to the present invention are not limited to use with cold and chilled beverages as such systems may very conveniently be used with containers of warm or hot beverages if dribbling or overflow of liquid is anticipated or simply with containers which are wet and might otherwise stain a table cloth or damage the top of a table or desk. It is to be understood, therefore, that the foregoing descriptions and appended drawings are for illustrative purposes only and are neither intended nor desired to limit the scope of this invention. Having thus described various embodiments of this invention, what is claimed as new and novel and desired to be protected by letters patent is as follows.

I claim:

1. Liquid control and storage system for use with a range of different sizes of generally cylindrical beverage containers, comprising a coaster having a generally circular base section, a generally continuous cylindrical wall member integral with and projecting upwardly from the outer periphery of said base section and defining an upwardly open receptacle sized to receive therein the lower portion of any container within the range, contact means extending inwardly from said wall member internally of said receptacle and comprising a plurality of inwardly directed, vertically spaced, concentric shoulders extending around the inner surface of said wall member in a generally parallel relationship with one another and with said base section, the inner periphery of said shoulders differing in diameter from one to another, being disposed in a stepped arrangement such that their inner peripheries increase in diameter with the distance from the base section, and being slightly smaller in diameter than but expanding around and releasably gripping the lower portion of any container within the range upon its insertion into said receptacle, said wall member defining a multiplicity of receptors comprising channels extending generally transversely of and through said shoulders, disposed for communication with said receptacle, and positioned to receive liquid draining into said receptacle from the sides of a container coupled to the coaster, storage means communicating with said receptors, said receptors being sized to permit the movement of liquid therethrough from said receptacle through said shoulders into said storage means, and means for restraining such liquid against egress from said storage means upon tilting of said container and coupled coaster.

2. A liquid control and storage system according to claim 1, characterized by said channels comprising a plurality of capillary channels formed in the inner surface of said wall member and arranged to receive liquid draining into said receptacle from the sides of a container coupled to the coaster and to provide a passage for the movement of such liquid through said shoulders into said storage means for storage therein.

3. A liquid control and storage system according to claim 2, characterized by said capillary channels being positioned within said receptacle to receive liquid draining from the sides of the container into said receptacle and transmit such liquid into a basin area formed between the bottom of the container and the upper surface of the base section, drainage means extending from said basin through said base section, and flow control means operatively positioned between said base section and said storage means and controlling the movement of liquid from said basin through said drain means and into said storage means for storage therein, said flow control means restraining such liquid against egress from said storage means upon tilting of said container and coupled coaster.

4. A liquid control and storage system according to claim 3, characterized by said coaster being comprised of a semi-resilient form retaining material, and said capillary channels extending transversely of and through said shoulder means substantially the interior height of said wall member.

5. Liquid control and storage system according to claim 4, characterized by said drainage means comprising a plurality of generally circular drain apertures extending through said base section, said flow control means comprising a control disc having a plurality of generally circular ports extending therethrough and communicating with said storage means, mounted on and forming with the lower surface of said base section a capillary space communicating with said drain apertures and said ports and transferring liquid from said basin through said drain apertures and said capillary space and said ports into said storage means for storage therein.

6. A liquid control and storage system according to claim 1 wherein the containers have a range of different sizes of upper closure rims, characterized by said storage means comprising a generally cup shaped member removably attached to said coaster proximate the lower edge of said wall member and having a generally circular bottom wall, a generally cylindrical side wall integral with and projecting upwardly from the periphery of said bottom wall and providing with said bottom wall an unobstructed generally cylindrical space sized to receive the upper end of a container having an upper closure rim within the range, and terminating on its open upper end in a flange extending outwardly beyond the proximate lower edge of said wall member, said flange being readily grippable manually and comprising means for diverting into said space for storage therein any liquid draining from the outer surface of said wall member.

7. A liquid control and storage system according to claim 2, characterized by said storage means comprising an absorbent member comprised of absorbent material
disposed within said receptacle proximate said base section and
provided with a multiplicity of interconnected capillary pores in communication with said channels and randomly distributed throughout said member.

8. A liquid control and storage system according to claim 7, characterized by said absorbent member comprising a generally circular disc of sintered synthetic plastic particles,
removably positioned within said receptacle proximate the inner surface of said base section and
the lower end of and communicating with said capillary channels, means for spacing said absorbent member from the inner surface of said base section, and means for isolating said base section from contact with a support surface on which said coaster may be placed.

9. A liquid control and storage system according to claim 8, characterized by said spacing means comprising ring members carried by said inner surface of said base section, said isolating means comprising a plurality of feet disposed around and extending downwardly from the periphery of said base section for contact with the support surface.

10. A liquid control and storage system according to claim 8, wherein said beverage containers have upper closure rims within a range of different sizes, characterized by said isolating means comprising a generally cup shaped member having a circular bottom wall, a generally cylindrical side wall integral with and projecting upwardly from the periphery of said bottom wall and
terminating in an open upper end, a plurality of vertically spaced, concentric annular recesses extending around the interior periphery of said side wall in a generally parallel relationship with one another and with said circular bottom wall, each said recess defining an inwardly directed upper and lower annular edge, with the lower edge of each said recess comprising the upper edge of the next lower recess,
the inner periphery of said recesses and said annular edges
differing in diameter from one to another,
being disposed in a stepped arrangement such that the diameter of their inner peripheries increase with the distance from said bottom wall, and means for removably positioning said cup shaped member below said base section for contact with the support surface, said cup shaped member being selectively removable from said base section for placement over the upper end of any container having an upper closure rim within the range, the inner periphery of the upper edge of each said recess being slightly smaller in diameter than but expanding to permit passage into said recess of at least one closure rim within the range of sizes.

11. A liquid control and storage system according to claim 10, characterized by said means for removably positioning said cup shaped member below said base section comprises a centrally disposed opening in the lower surface of said base section, a centrally disposed mounting arm projecting from said bottom wall into releasable engagement with said opening, and interengaging elements between and releasably holding said arm within said opening.

12. A liquid control and storage system for use with a range of different sizes of generally cylindrical beverage containers, comprising a coaster comprised of a semi-resilient form retaining material and provided with
a base section,
a generally continuous wall member integral with and projecting upwardly from said base section and terminating in an upper rim defining an upwardly open receptacle sized to receive therein the lower portion of any container within the range,
contact means
provided by said wall member internally of said receptacle and
comprising inwardly directed shoulder means extending around the inner surface of said wall member for engaging and releasably coupling said coaster to the lower portion of any container within the range upon its insertion into said receptacle, said wall member defining a multiplicity of receptors
comprised of capillary channels,
extending generally vertically through said upper rim and said shoulder means substantially the height of said wall member and
positioned to
receive liquid draining through said upper rim into said receptacle from the sides of a container coupled to said coaster and
to transmit such liquid into a basin formed between the bottom of the container and the upper surface of the base section, drainage means comprising a plurality of capillary drain apertures extending from said basin through said base section, storage means provided by said base section, and flow control means comprising a control disc
operatively positioned between said base section and said storage means,
having a plurality of capillary ports extending through said control disc and communicating with said storage means, and
mounted on and forming with the lower surface of said base section a capillary space communicating with said drain apertures and said ports and transferring liquid from said basin through said drain apertures and said capillary space and said ports into said storage means for storage therein, and
restraining said liquid against egress from said storage means upon tilting said container and coupled coaster.

13. A liquid control and storage system according to claim 2 wherein the containers are generally cylindrical, characterized by said base section being generally circular, said wall member being generally cylindrical and projecting upwardly from the outer periphery of said base section and terminating in said upper rim, said shoulder means comprising a plurality of inwardly directed, vertically spaced, concentric shoulders extending around the inner surface of said wall member in a generally parallel relationship with one another and with said base section, the inner periphery of said shoulders being segmented by said channels differing in diameter from one to another, being disposed in a stepped arrangement such that their inner peripheries increase in diameter with the distance from the base section, and being slightly smaller in diameter than but expanding and releasably gripping the lower portion of any container within the range upon its insertion into said receptacle.

14. A liquid control and storage system according to claim 13, characterized by said upper rim of said wall member defining a relatively narrow circular surface sloping inwardly toward the interior of said receptacle and funneling liquid draining from the sides of the container into said receptacle and said capillary channels therein, means for releasably mounting said control disc on said base section, and means for releasably attaching said storage means to said control disc.

15. Liquid control and storage system according to claim 14, characterized by said storage means comprising a generally cup shaped member having a circular bottom wall, a generally cylindrical side wall integral with and projecting upwardly from the periphery of said bottom wall and terminating in an open upper end, an annular recess extending around the interior periphery of said side wall proximate its open upper end and defining inwardly directed upper and lower annular edges, said control disc being generally circular and terminating on its outer periphery in a flange sized to releasably snap over said upper edge into said annular recess, said annular recess and said flange comprising said releasable attaching means.

16. A liquid control and storage system according to claim 15, characterized by said flange being narrower than said annular recess, a plurality of fingers provided around the outer periphery of said control disc underlying said flange, the distal ends of said fingers being sized to snap over said upper edge and into said annular recess with said flange and engaging said lower edge, said fingers being semi-resilient and biasing said control disc upwardly to a position wherein said flange is in engagement with said upper edge substantially closing said upper end and permitting movement of said control disc downwardly to a position wherein said flange is spaced from said upper edge upon the application of pressure to said control disc.

17. A liquid control and storage system according to claim 16, characterized by means for establishing said capillary space between said lower surface of said base section and said upper surface of said control disc, said releasable mounting means comprising a centrally disposed opening in the lower surface of said base section, a centrally disposed mounting arm projecting from the upper surface of said control disc into said opening, and interengaging indent and offset elements operatively disposed between said opening and said mounting arm and positioned such that upon engagement of said indent and offset elements the upper surface of said control disc is positioned and maintained in contact with the lower surface of said base section to maintain said capillary space.

18. A liquid control and storage system according to claim 17, characterized by said centrally disposed opening being generally cylindrical, said centrally disposed mounting arm being generally cylindrical and of a diameter slightly smaller than that of said opening, said interengaging indent and offset elements being generally circular, concentric with said opening and said arm and defined by the generally cylindrical peripheral surfaces of said arm and said opening, said spacing means comprising a series of relatively thin annular rings concentric with one another and with said opening and said arm, spaced radially from one another, and operatively disposed between said lower and upper surfaces.

19. A liquid control and storage system according to claim 18, characterized by said drain apertures being positioned in said base section in a generally circular pattern concentric with and spaced radially outwardly from said centrally disposed opening and communicating at one end with said basin and at the other end with said capillary space, said ports being positioned in said control disc in a generally circular pattern concentric with and spaced radially inwardly from said drain apertures, and communicating at one end with said capillary space and at the other end with said storage means.

20. A liquid control and storage system according to claim 12, wherein said beverage containers have a range of different sizes of upper closure rims, characterized by said cup shaped storage means having a plurality of vertically spaced, concentric annular recesses extending around the interior periphery of said side wall in a generally parallel relationship with one another and with said circular bottom wall, each said recess defining an inwardly directed upper and lower annular edge, with the lower edge of each said recess comprising the upper edge of the next lower recess, the inner peripheries of said recesses and said annular edges differing in diameter from one to another, being disposed in a stepped arrangement such that they increase in diameter with the distance from said bottom wall, and said storage means being selectively removable from said control disc for placement of its open end over the upper end of any container having a closure rim in the range, the inner periphery of the upper edge of each said recess being slightly smaller in diameter than but expanding to permit passage into said recess of at least one size of closure rim.

21. A liquid control and storage system according to claim 20, characterized by the closure rim of the container being sealingly engaged by one of said recesses and the upper and lower edges thereof to seal the interior of the container from the atmosphere and prevent contamination or loss of the contents of the container after being opened.

22. A liquid control and storage system for use with generally cylindrical beverage containers having a range of different sizes of upper closure rims, characterized by a generally cup shaped member having
- a generally circular end wall,
- a generally cylindrical side wall
  - integral with and projecting upwardly from the periphery of said end wall and providing with said end wall an unobstructed generally cylindrical space sized to receive the upper end of a container having an upper closure rim within the range, and
  - terminating in an open upper end sized to receive and permit insertion of such upper container end and upper closure rim into said unobstructed cylindrical space, a plurality of vertically spaced, concentric annular recesses
- positioned in said cylindrical space,
- formed on and extending around the inner periphery of said side wall, and
- disposed in a generally parallel relationship with one another and with said circular bottom wall, each said recess defining an inwardly directed upper and lower annular edge, with the lower edge of each said recess comprising the upper edge of the next lower recess, the inner periphery of said recesses and said annular edges
- differing in diameter from one to another,
- being disposed in a stepped arrangement such that the diameter of their inner peripheries increase with the distance from said bottom wall, and the inner periphery of the upper edge of each said recess being slightly smaller in diameter than but expanding to permit passage into said recess of an upper closure rim within the range of sizes upon placement of said cup shaped member over the upper end of a container having an upper closure rim within said range, said upper closure rim being sealingly engaged by said recess and the upper and lower edges thereof to seal the interior of the container from the atmosphere and store the contents thereof from contamination or loss after the container has been opened.

23. A liquid control and storage system for use with a range of different sizes of beverage containers having upper closure rims within a range of different sizes, comprising a coaster having
- a generally circular base section,
- a generally circular continuous wall member
  - integral with and projecting upwardly from the outer periphery of said base section and
  - defining an upwardly open receptacle sized to receive the lower portion of any container within the range, contact means provided by said wall member internally of said receptacle for engaging and releasably coupling said coaster to the lower portion of any container within the range upon its insertion into said receptacle, said contact means comprising a plurality of inwardly directed, vertically spaced, concentric shoulders extending around the inner surface of said wall member in a generally parallel relationship with one another and with said base section, the inner periphery of said shoulders
- differing in diameter from one to another and
- being disposed in a stepped arrangement such that the diameter of their inner peripheries increase with the distance from the base section,
- being slightly smaller in diameter than but expanding and releasably gripping the lower portion of any container within the range upon its insertion into the receptacle, storage means removably attachable to said coaster, said wall member defining a multiplicity of receptors comprising capillary channels formed in the inner surface of said wall member and arranged to receive liquid draining from the sides of a container into said receptacle and to provide a passage for the movement of such liquid through said shoulders into said storage means for storage therein said storage means comprising a generally cup shaped member having
- a circular end wall,
- a generally cylindrical side wall integral with and projecting upwardly from the periphery of said end wall and
  - terminating in an open upper end sized to receive the upper portion of any of the containers having an upper rim within the range,
- a plurality of vertically spaced, concentric annular recesses formed on and extending around the interior periphery of said side wall in a generally parallel relationship with one another and with said circular bottom wall,
- each said recess defining an inwardly directed upper and lower annular edge, with the lower edge of each said recess comprising the upper edge of the next lower recess,
- the inner periphery of said recesses and said annular edges
  - differing in diameter from one to another,
  - being disposed in a stepped arrangement such that the diameter of their inner peripheries increase with the distance from said bottom wall, and
- the inner periphery of the upper edge of each said recess being slightly smaller in diameter than but expanding to permit passage into said recess of a closure rim within the range upon placement of said cup shaped member over the upper portion of said container,
- said closure rim being sealingly engaged by such recess and the upper and lower edges thereof to seal the interior of the container from the atmosphere and store the contents thereof from contamination or loss after the container has been opened and said storage means removed from said coaster.

24. A liquid control and storage system according to claim 23, characterized by each of said shoulders providing a plurality of inwardly projecting splines spaced uniformly around said shoulder, the apexes of said splines defining generally circular areas comprising said expandable inner peripheries of said shoulders.

* * * * *